US009487025B2

(12) United States Patent
Kitagishi

(10) Patent No.: US 9,487,025 B2
(45) Date of Patent: Nov. 8, 2016

(54) PRINTING APPARATUS

(71) Applicant: SEIKO EPSON CORPORATION, Tokyo (JP)

(72) Inventor: Mikio Kitagishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/871,340

(22) Filed: Sep. 30, 2015

(65) Prior Publication Data

US 2016/0089904 A1 Mar. 31, 2016

(30) Foreign Application Priority Data

Sep. 30, 2014 (JP) ..... 2014-200705

(51) Int. Cl.
*B41J 11/00* (2006.01)

(52) U.S. Cl.
CPC ..... *B41J 11/0005* (2013.01)

(58) Field of Classification Search
CPC ..... B41J 11/0045; B41J 11/0005
USPC ..... 347/104
See application file for complete search history.

(56) References Cited

U.S. PATENT DOCUMENTS 4,948,282 A * 8/1990 Koike ..... B41J 11/30 101/288
2004/0091283 A1* 5/2004 Nobe ..... G03G 15/6508 399/110
2005/0024463 A1* 2/2005 Kida ..... B41J 11/0005 347/104
2005/0053394 A1* 3/2005 Ishii ..... G03G 21/1821 399/111
2011/0025796 A1* 2/2011 Matsuya ..... B41J 11/0005 347/104
2014/0132691 A1 5/2014 Ishikawa et al.

FOREIGN PATENT DOCUMENTS

JP 2014-094540 5/2014

* cited by examiner

*Primary Examiner* — Stephen Meier
*Assistant Examiner* — Alexander D Shenderov
(74) *Attorney, Agent, or Firm* — Workman Nydegger

(57) ABSTRACT

A printing apparatus includes: a transport unit that transports a medium in a transport direction; a medium support that supports the medium; a medium pressing unit that has a first regulation section that regulates bending of an end portion of the medium from the medium support in a width direction intersecting with the transport direction and a second regulation section that regulates moving of the end portion of the medium to an outer side in the width direction; and a printing unit that performs printing on the medium supported on the medium support.

5 Claims, 10 Drawing Sheets

PRINTING APPARATUS

BACKGROUND

1. Technical Field

The present invention relates to a printing apparatus that performs printing on a medium such as a sheet of paper.

2. Related Art

In the related art, as an example of a printing apparatus, an ink jet type printer that ejects an ink on a medium supported on a medium support and thereby performs printing on the medium is known. Among such printers, in order to suppress a medium not to bend from a medium support during printing on or transporting the medium, there is a printer that includes a medium pressing unit which presses (pushes) both end portions of a medium in a width direction intersecting with a transport direction (for example, JP-A-2014-94540).

Incidentally, in the printing apparatus described above, since the medium pressing unit is provided to suppress the both end portions of the transported medium in the width direction not to bend from the medium support, there is a concern that it will not be possible to suppress a medium not to skew off a designed transport direction. When the medium skews, there is a concern that ink is discharged at a position different from a position at which the ink is discharged in a case where the medium does not skew and thus, print quality will deteriorate.

SUMMARY

An advantage of some aspects of the invention is to provide a printing apparatus in which it is possible to suppress a medium not to skew over a medium support along with transporting of the medium in a transport direction.

Hereinafter, means of the invention and operation effects thereof will be described.

According to an aspect of the invention, there is provided a printing apparatus including: a transport unit that transports a medium in a transport direction; a medium support that supports the medium; a medium pressing unit that has a first regulation section that regulates bending upward of an end portion of the medium from the medium support in a width direction intersecting with the transport direction and a second regulation section that regulates a movement of the end portion of the medium to an outer side in the width direction; and a printing unit that performs printing on the medium supported on the medium support.

According to the configuration, in a state in which the first regulation section of the medium pressing unit regulates the bending of the end portion of the medium in the width direction, printing is performed on the medium. Here, when the medium skews over the medium support along with transporting of the medium, one end side of the medium in the width direction is likely to move to the outer side from the first regulation section in the width direction.

Then, the second regulation section regulates the movement of the medium which is likely to move to the outer side from the first regulation section in the width direction. That is, the second regulation section suppresses the medium not to skew beyond a regulation range. Therefore, according to the printing apparatus having the configuration described above, it is possible to suppress the medium not to skew over the medium support along with the transport of the medium in the transport direction.

In the printing apparatus according to above aspect, it is preferable that the second regulation section is provided on the upstream side from the first regulation section in the transport direction.

According to the configuration, the medium has a side-end surface intersecting with the width direction which is likely to come into contact with the second regulation section at a stage at which the medium transported over the medium support starts skewing, that is, at a stage at which a skewing amount of the medium is small, compared to a case where the second regulation section is provided on the downstream side from the first regulation section in the transport direction. Therefore, it is possible to suppress the medium not to skew along with the transport of the medium.

In the printing apparatus according to above aspect, it is preferable that the second regulation section has at least a part which overlaps with the first regulation section in the width direction.

According to the configuration, the medium has the side-end surface intersecting with the width direction which is likely to come into contact with the second regulation section at a stage at which a skewing amount of the medium is small, compared to a case where the second regulation section is provided not to overlap with the first regulation section. Therefore, it is possible to suppress the medium not to skew along with the transport of the medium.

In the printing apparatus according to above aspect, it is preferable that the first regulation section has an inclined portion which is inclined to have a gap that is gradually wider from the medium support toward the upstream side in the transport direction, and the second regulation section and the inclined portion are connected on the downstream side in the transport direction.

In the printing apparatus, the medium pressing unit is disposed to be changed in the width direction depending on a medium which is different in length in the width direction. Here, when the medium which is different in length in the width direction is transported on a support member without changing the disposition of the medium pressing unit, there is a concern that it will not be possible for the medium pressing unit to suppress the end portion of the medium in the width direction not to bend and the medium will come into contact with the printing unit.

In this respect, according to the configuration, when the medium which is different in length in the width direction is transported on the support member without changing the disposition of the medium pressing unit, an end of the medium on the downstream side in the transport direction advances between the second regulation section and the inclined portion and collides with a connection portion between the second regulation section and the inclined portion. In this manner, the medium to be transported is not transported over the connection portion and thereby, it is possible to notify a user of the printing apparatus that the medium pressing unit is not disposed at a preferred position.

In the printing apparatus according to above aspect, it is preferable that the first regulation section and the second regulation section in the medium pressing unit are formed through integral molding.

According to the configuration, since the first regulation section and the second regulation section are formed through the integral molding, it is possible for the medium pressing unit to have a simple configuration.

BRIEF DESCRIPTION OF THE DRAWINGS

The invention will be described with reference to the accompanying drawings, wherein like numbers reference like elements.

FIG. 6A is a plan view, FIG. 6B is a side view, and FIG. 6C is a sectional view taken along line VIC-VIC viewed in an arrow direction.

FIG. 7A is a plan view and FIG. 7B is a side sectional view.

FIG. 8A is a plan view and FIG. 8B is a side sectional view.

FIG. 9A illustrates a mode in which the medium is transported without skewing and FIG. 9B illustrates a mode in which skewing of the medium is regulated.

DESCRIPTION OF EXEMPLARY EMBODIMENTS

Hereinafter, an embodiment in which the printing apparatus is specified by an ink jet type printer will be described with reference to the drawings. The printing apparatus according to the present embodiment is a large-format printer (LFP) which uses a long sheet of paper as a medium.

Figure 1:
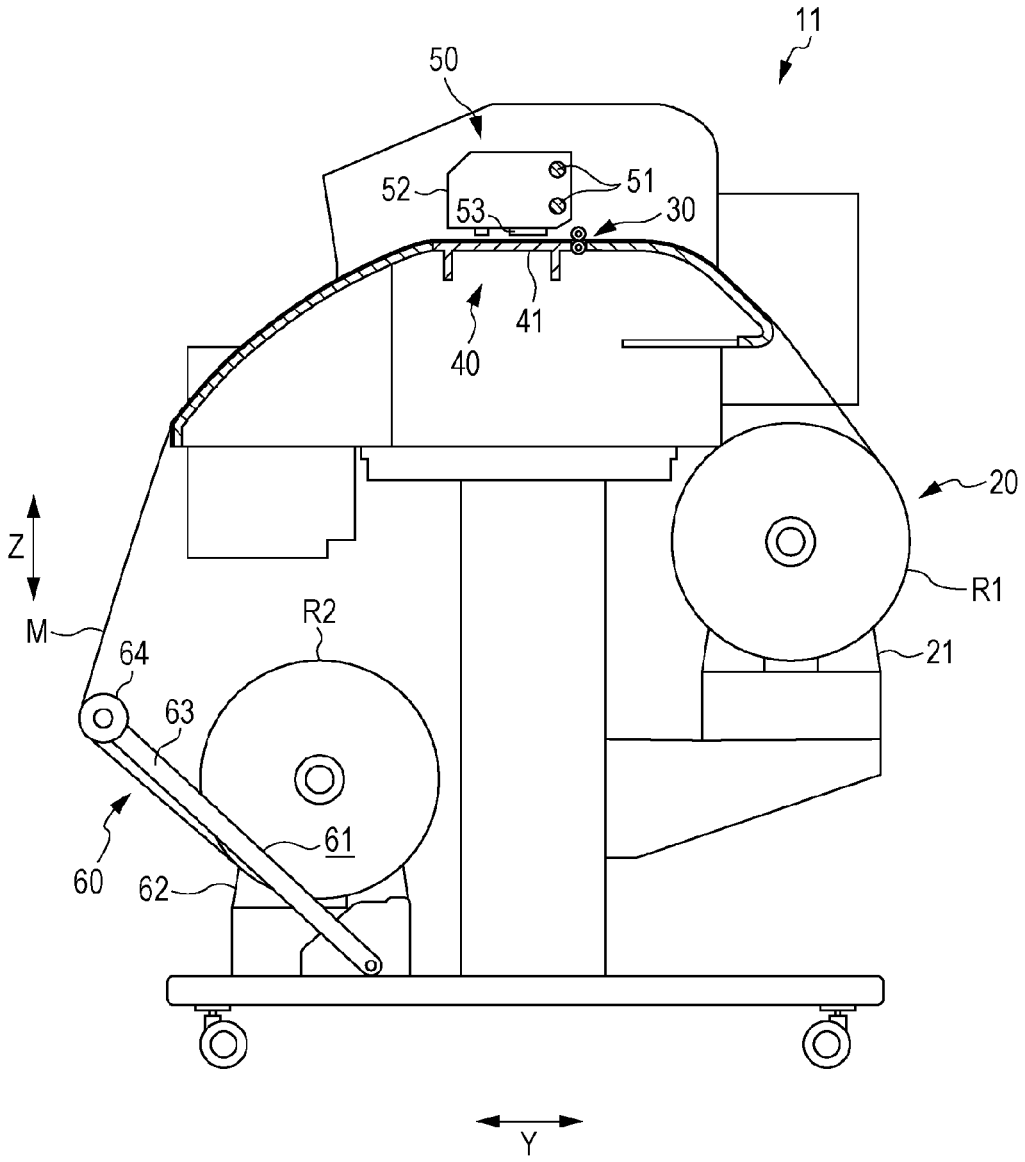
FIG. 1 is a side sectional view schematically illustrating a configuration of a printing apparatus.

As illustrated in FIG. 1, the printing apparatus 11 includes an unwinding unit 20 which unwinds a medium M wound into a roll, a transport unit 30 which transports the medium M, a guide unit 40 that guides the medium M, a printing unit 50 that performs printing on the medium M, and a winding unit 60 that winds the medium M on which the printing is completed. In the following description, a width direction of the printing apparatus 11 (direction orthogonal to the paper surface in FIG. 1) is referred to as a "width direction X", a frontward-rearward direction of the printing apparatus 11 (right-left direction in FIG. 1) is referred to as a "frontward-rearward direction Y", and a perpendicular direction (vertical direction in FIG. 1) is referred to as a "perpendicular direction Z".

As illustrated in FIG. 1, the unwinding unit 20 has a holding section 21 which holds a rolled body R1 having a roll shape into which the medium M is wound. In the holding section 21, a plurality of rolled bodies R1 which are different in length in the width direction X and in the number of winding. The unwinding unit 20 causes the rolled body R1 to rotate in one direction (counterclockwise direction in FIG. 1) when the medium M unwound from the rolled body R1 is fed to the downstream side in a movement direction.

Figure 2:
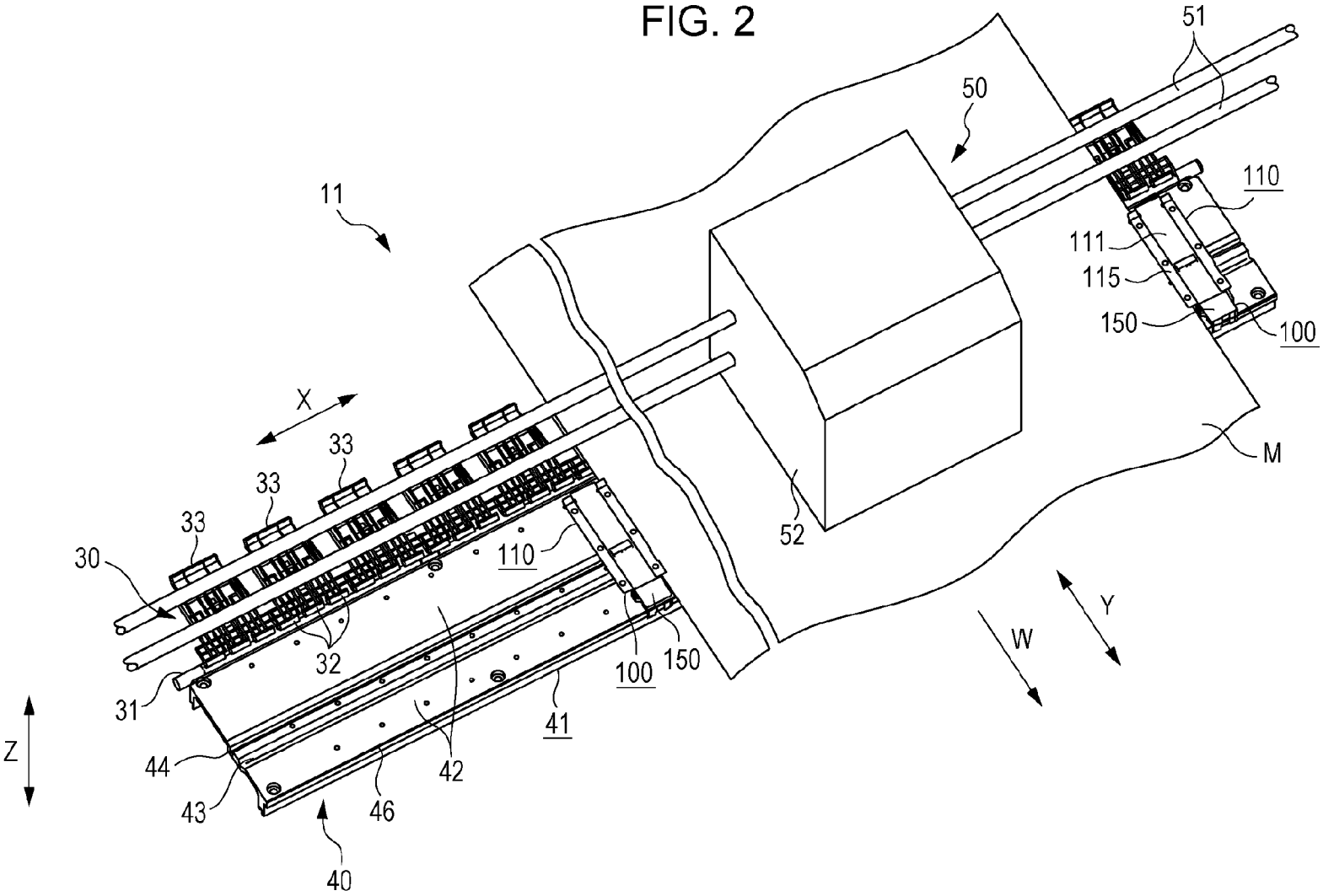
FIG. 2 is a perspective view illustrating a guide unit and a recording unit of the printing apparatus.
Figure 3:
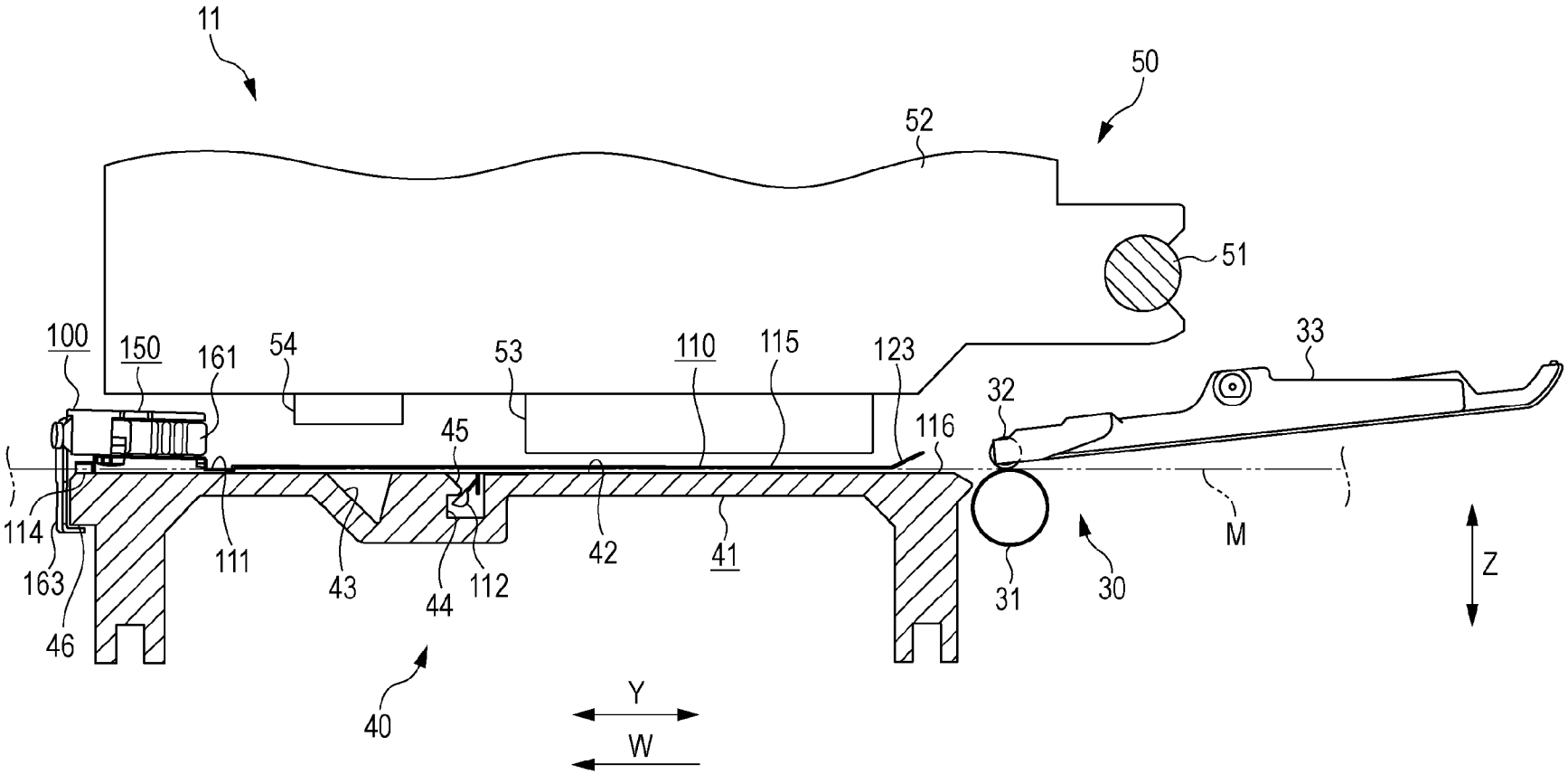
FIG. 3 is a side sectional view illustrating the guide unit and the recording unit of the printing apparatus.

As illustrated in FIG. 2 and FIG. 3, the transport unit 30 includes a transport roller 31 which applies a transport force to the medium M in the transport direction, a following roller 32 which presses the medium M against the transport roller 31, and a medium pressing plate 33 that rotatably supports the following roller 32. Here, the transport direction (hereinafter, referred to as a "transport direction W") means the movement direction of the medium M in the transport unit 30, the guide unit 40, and the printing unit 50 and corresponds to a frontward direction in the frontward-rearward direction Y. Thus, in the following description, the transport direction W means the movement direction of the medium M in the transport unit 30, the guide unit 40, and the printing unit 50.

The transport roller 31 is substantially cylindrical with the width direction X as a longitudinal direction and rotates in any direction with the longitudinal direction as a rotating axis direction through driving of the drive motor (not illustrated). In addition, the medium pressing plate 33 is swingably supported with the width direction X as a rotating axis direction and changes disposition of the following roller 32 in the perpendicular direction Z depending on a thickness of the transported medium M. Thus, the transport unit 30 transports the medium M to the downstream side in the transport direction through driving the transport roller 31 in a state in which the medium M is pinched in the perpendicular direction Z by the transport roller 31 and the following roller 32 supported by the medium pressing plate 33.

As illustrated in FIG. 2 and FIG. 3, the guide unit 40 includes a medium support 41 that perpendicularly supports the transported medium M from below and a medium pressing unit 100 that presses both end portions of the medium M in the width direction X against the medium support 41. Here, the medium pressing unit 100 is mounted over the medium support 41. In addition, in the following description, a state in which the medium pressing unit 100 is mounted over the medium support 41 is referred to as "when the medium pressing unit 100 is mounted".

As illustrated in FIG. 2 and FIG. 3, the medium support 41 has substantially a rectangular plate shape with the width direction X as the longitudinal direction and with the transport direction W as a traverse direction. Here, a surface of the medium support 41 which can face the printing unit 50 and intersects with the perpendicular direction Z becomes a support surface 42 which comes into contact with the medium M when the medium support 41 supports the medium M. In addition, a detection groove 43 and a latching groove 44 are provided in the medium support 41 along the width direction X to be recessed perpendicularly below from the support surface 42. As illustrated in FIG. 3, a convex latching portion 45 along the width direction X is formed in the latching groove 44 provided on the upstream side from the detection groove 43 in the transport direction to have a protruding shape on the downstream side in the transport direction. A protruding section 46 is formed along the width direction X on an end of the medium support 41 on the downstream side in the transport direction to protrude on the downstream side in the transport direction.

As illustrated in FIG. 3, the printing unit 50 includes a guide shaft 51 having a longitudinal direction in the width direction, a carriage 52 that is supported by the guide shaft 51, a print head 53 that discharge ink on the medium M, and an optical sensor 54 that detects a length of the medium M in the width direction X.

The carriage 52 reciprocates in the width direction X also corresponding to the longitudinal direction of the guide shaft 51 through driving of a carriage motor (not illustrated). The print head 53 is perpendicularly held under the carriage 52 to face the transported medium M over the medium support 41. Then, when the carriage 52 reciprocates in the width direction X, the print head 53 discharges ink at an appropriate timing and thereby forms a character or an image on the medium M.

The optical sensor 54 is perpendicularly held under the carriage 52 to face the detection groove 43 of the medium support 41. The optical sensor 54 detects presence or absence of the medium M on the detection groove 43 in response to reflection intensity of irradiating light, that is, a difference between reflection intensity obtained when the medium M is irradiated with light and reflection intensity obtained when the detection groove 43 is irradiated with light, and thereby detects a length of the medium M in the width direction X.

As illustrated in FIG. 1, the winding unit 60 includes a tension imparting mechanism 61 which imparts tension to the medium M and a holding section 62 that holds a rolled body R2 in a roll shape into which the medium M, on which printing is completed, is wound. The tension imparting mechanism 61 includes an arm member 63 which is swingably supported and a tension roller 64 which is rotatably supported on a tip portion of the arm member 63. Thus, in a state in which the tension roller 64 imparts tension to the medium M, the winding unit 60 causes the region R2 to rotate in one direction (counterclockwise direction in FIG. 1) and thereby performs winding of the medium M on the region R2.

Next, the medium pressing unit 100 will be described with reference to FIG. 4A to FIG. 7B. In the following description, the width direction X, the frontward-rearward direction Y, the perpendicular direction Z, and the transport direction W are defined in a state in which the medium pressing unit 100 is mounted over the medium support 41.

Figure 4A:
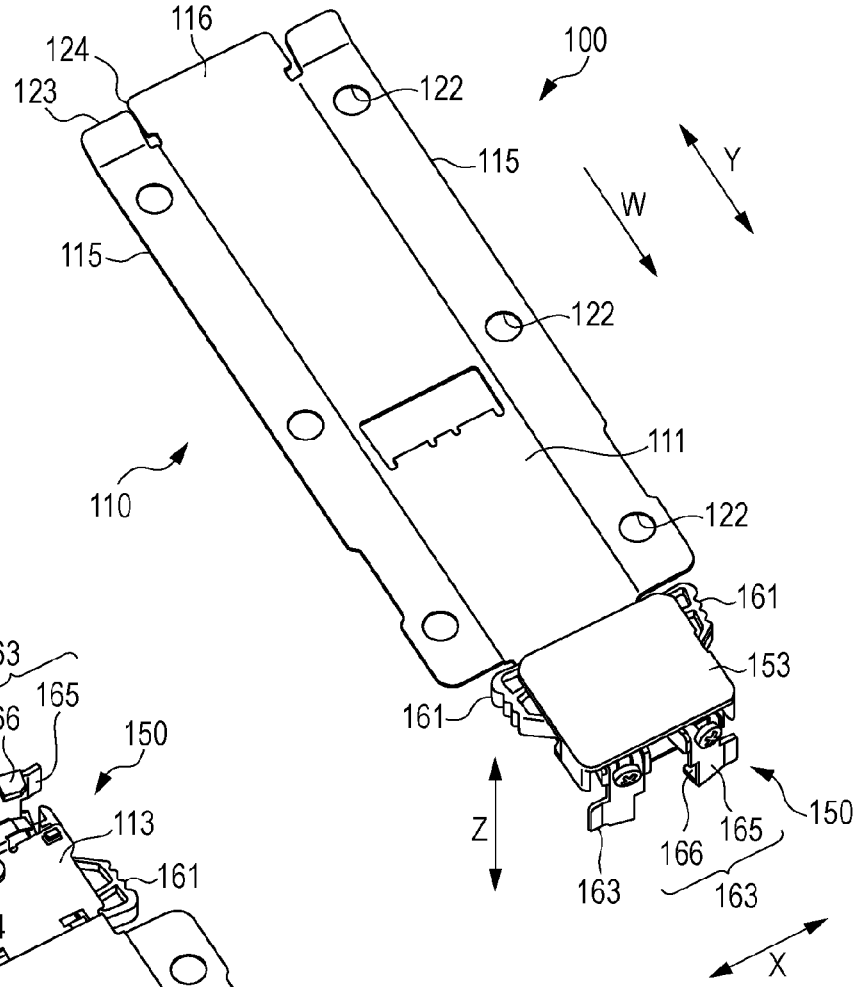
FIGS. 4A and 4B are perspective views illustrating a medium pressing unit.
Figure 4B:
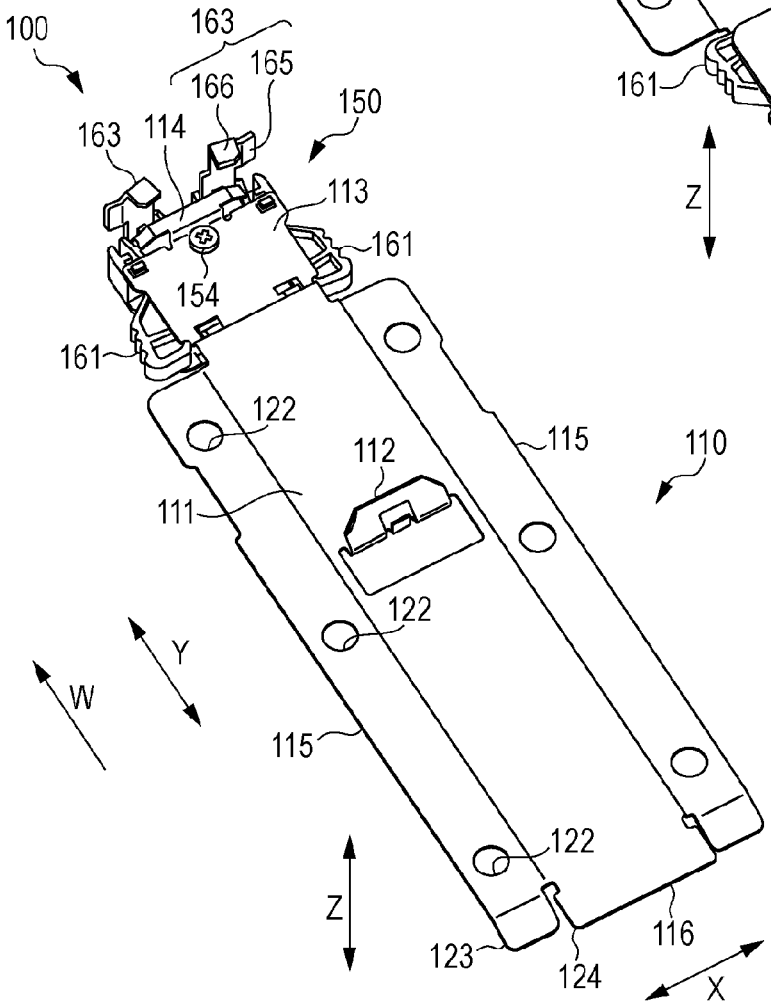

As illustrated in FIGS. 4A and 4B, the medium pressing unit 100 includes a pushing plate 110 which pushes (presses) an end portion of the medium M in the width direction X and a switching section 150 which switches a pushing state of the pushing plate 110 against the medium support 41.

Figure 5:
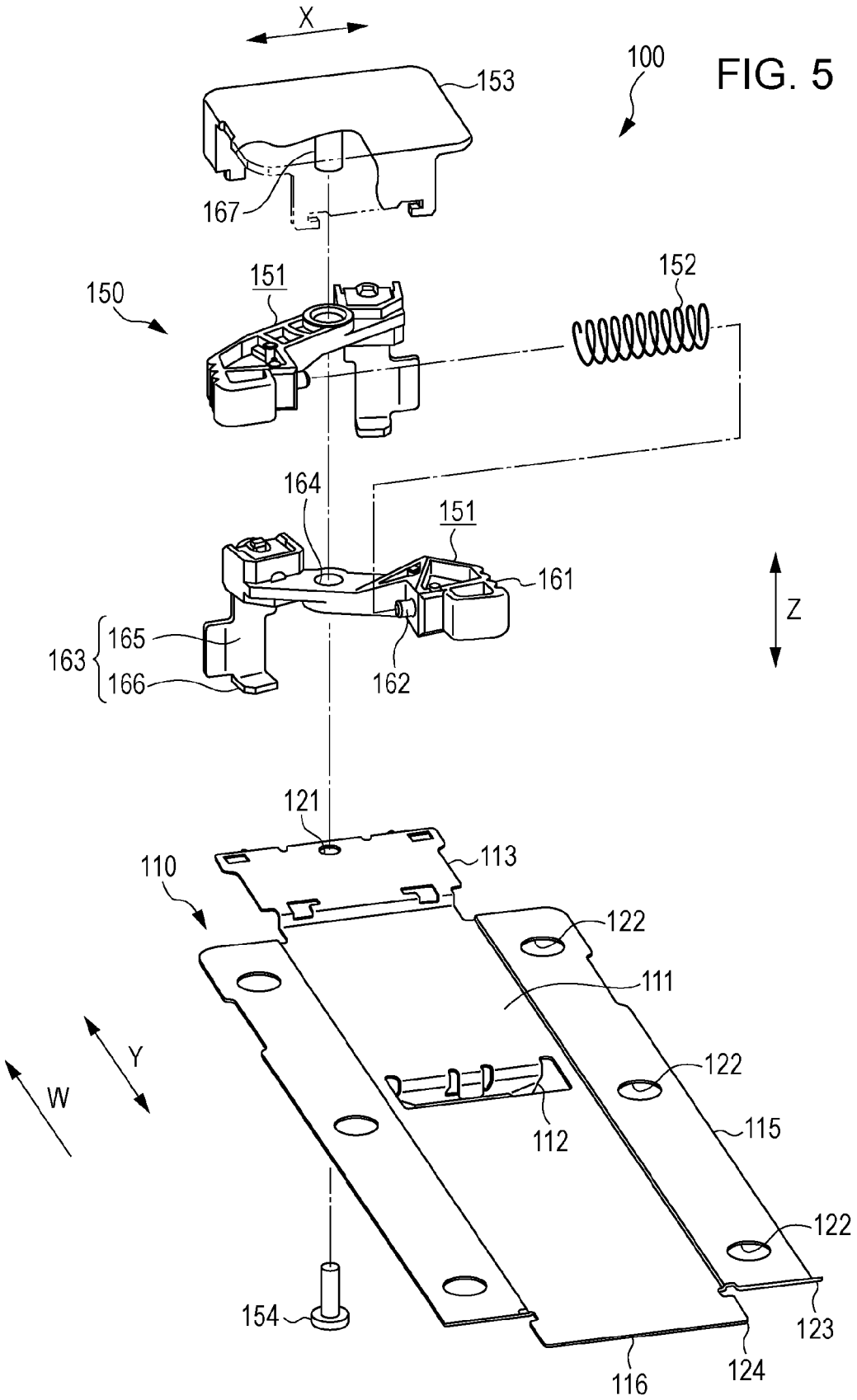
FIG. 5 is an exploded perspective view illustrating the medium pressing unit.

As illustrated in FIGS. 4A and 4B and FIG. 5, when the medium pressing unit 100 is mounted, the pushing plate 110 includes a base plate section 111 which comes into surface contact with a support surface 42 of the medium support 41, a latching portion 112 which is latched to the latching groove 44 of the medium support 41, and an attachment portion 113 to which the switching section 150 is attached. In addition, when the medium pressing unit 100 is mounted, the pushing plate 110 includes a curvature forming portion 114 (refer to FIG. 4B) which causes the pushing plate 110 to be curved along a longitudinal direction thereof, a first regulation section 115 which suppresses bending of the medium M from the medium support 41, and a second regulation section 116 which suppresses skewing of the medium M along with the transport.

According to the present embodiment, the pushing plate 110 has substantially a rectangular shape symmetrical in the width direction X and is formed through punching or bending of an elastic metal plate. That is, according to the present embodiment, the base plate section 111, the latching portion 112, the attachment portion 113, the curvature forming portion 114, the first regulation section 115, and the second regulation section 116 configure the pushing plate 110 and are all formed through integral molding.

As illustrated in FIG. 5, the attachment portion 113 is formed to curve such that a step is formed perpendicularly upward from the base plate section 111 on one end side (downstream side in the transport direction) of the base plate section 111 in the longitudinal direction. An attachment hole 121 for attaching the switching section 150 is formed to penetrate through the attachment portion 113 in the perpendicular direction Z. In addition, the latching portion 112 is formed substantially at the center of the base plate section 111 in the longitudinal direction to curve toward the attachment portion 113 side as bending perpendicularly downward from the base plate section 111.

As illustrated in FIG. 4B, the curvature forming portion 114 is formed to curve such that a step is formed perpendicularly below from the attachment portion 113 on a side opposite to the side on which the base plate section 111 is provided when viewed from the attachment portion 113. Here, a distance from the attachment portion 113 as a reference to the curvature forming portion 114 in the perpendicular direction Z is longer than a distance from the attachment portion 113 to the base plate section 111. Thus, when the medium pressing unit 100 is mounted, the curvature forming portion 114 comes into surface contact with the support surface 42 of the medium support 41.

As illustrated in FIGS. 4A and 4B and FIG. 5, the first regulation sections 115 are formed to curve such that steps are formed perpendicularly above from the base plate section 111 on both sides of the base plate section 111 in a traverse direction (width direction X). A plurality of viewing windows 122 arranged in the longitudinal direction (transport direction W) of the first regulation section 115 are formed to penetrate through the first regulation section 115 in the perpendicular direction Z. In addition, an inclined portion 123 is provided on the other end side (upstream side in the transport direction) of the first regulation section 115 in the longitudinal direction to be inclined such that a gap between the base plate section 111 (second regulation section 116) and the first regulation section 115 becomes gradually wider in the perpendicular direction Z toward the other end side. Here, the inclined portion 123 and the second regulation section 116 are connected on one end side (downstream side in the transport direction) of the base plate section 111 in the longitudinal direction through the base plate section 111 and the first regulation section 115 in the width direction X.

The second regulation section 116 is provided at the other end side (upstream side in the transport direction) of the base plate section 111 in the longitudinal direction to be flush with the base plate section 111. That is, when the medium pressing unit 100 is mounted, the second regulation section 116 comes into surface contact with the support surface 42 of the medium support 41 along with the base plate section 111. In addition, a contact surface 124 having a round chamfer is formed on a corner of the second regulation section 116, at which a side surface intersecting with the width direction X intersects with a side surface intersecting with the transport direction W.

Figure 6A:
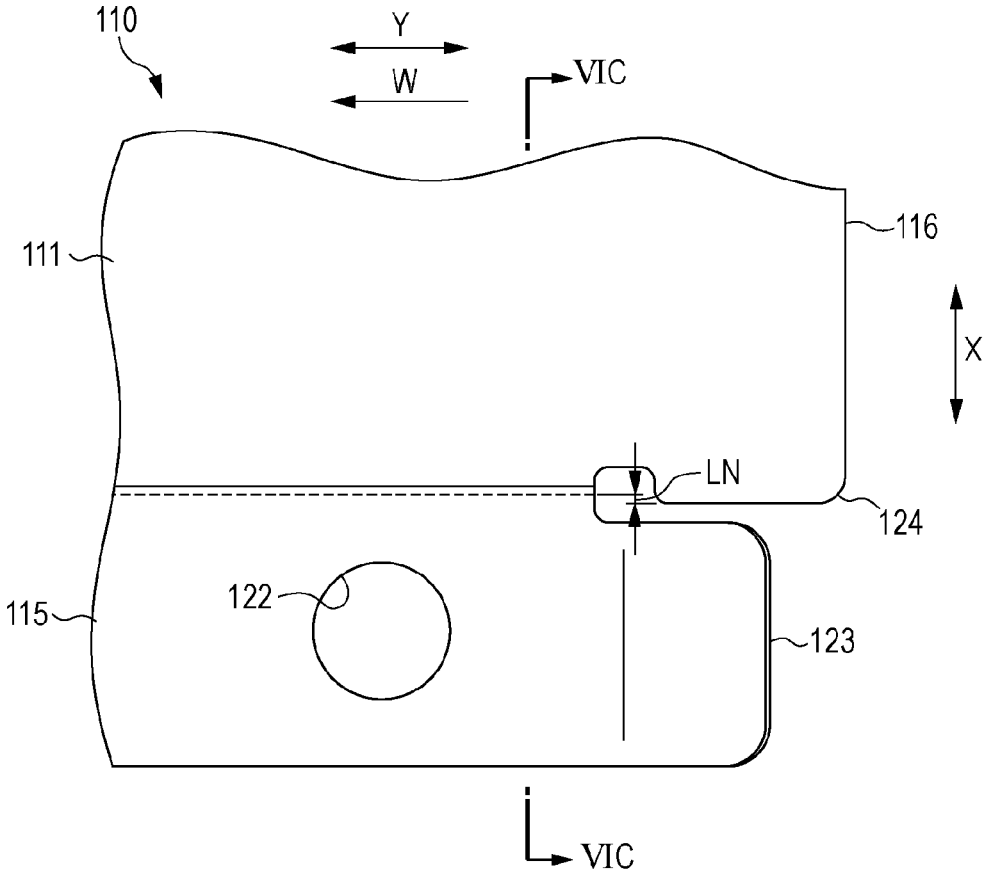
FIGS. 6A to 6C are views illustrating a part of a configuration of the medium pressing unit.
Figure 6B:
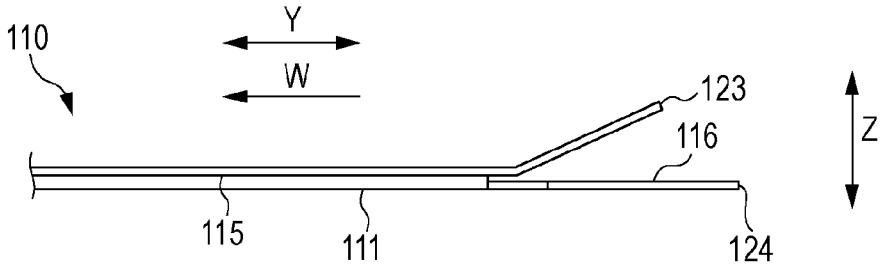
Figure 6C:
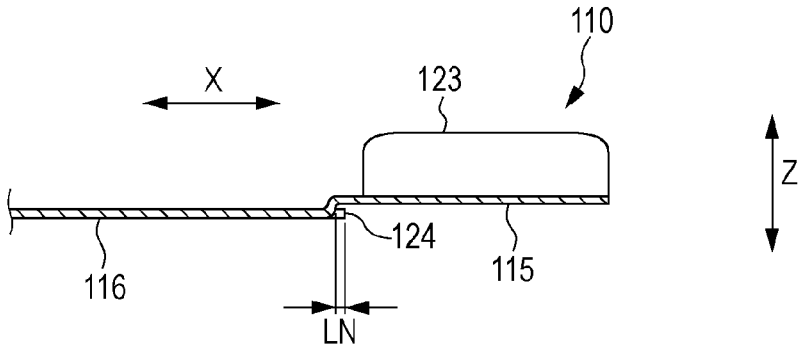

In addition, as illustrated in FIGS. 6A, 6B, and 6C, the second regulation section 116 is provided on a side opposite in the width direction X to the side on which the medium M is transported when viewed from the first regulation section 115 to have at least a part in the width direction X, which overlaps with the first regulation section 115. Accordingly, in the pushing plate 110, when the side on which the base plate section 111 is provided is referred to as an inner side in the width direction X and the side on which the first regulation section 115 is provided is referred to as an outer side in the width direction X, an inner side portion of the first regulation section 115 in the width direction X is positioned further on the inner side than an outer side portion (contact surface 124) by a length of a distance LN in the width direction X. In addition, the second regulation section 116 (contact surface 124) is provided on the upstream side in the transport direction from the first regulation section 115 and further, is provided on the pushing plate 110 on the most upstream side in the transport direction.

Subsequently, the switching section 150 of the medium pressing unit 100 will be described.

As illustrated in FIG. 5, the switching section 150 includes a pair of claw-like rotary members 151 which have a claw-like shape from the base end portion toward the tip portion, a coil spring 152 which biases the rotary members 151, a cover member 153 which perpendicularly covers the rotary members 151 and the coil spring 152 from above, and a connection member 154 which connects the switching section 150 with the pushing plate 110.

In the rotary member 151, grip portions 161 which are gripped on the outer sides of the base end portion in the width direction by a user and a spring receiving portion 162 which supports the coil spring 152 on the inner side in the base end portion in the width direction is provided. In addition, an engagement portion 163 which can engage with the protruding section 46 of the medium support 41 is provided on the tip portion of the rotary member 151. Further, a through-hole 164 is formed to penetrate through in the perpendicular direction Z between the base end portion and the tip portion of the rotary member 151.

In the rotary member 151, the engagement portion 163 has a first engagement portion 165 extending in the perpendicular direction Z and a second engagement portion 166 extending in a direction intersecting with the perpendicular direction Z. Here, the second engagement portion 166 is formed to be bent rearward at an angle of substantially 90 degrees with respect to the first engagement portion 165. In addition, the first engagement portion 165 is formed to have a curved convex surface toward a direction in which the second engagement portion 166 is folded.

On the cover member 153, a substantially cylindrical shaft 167 extending perpendicularly downward from the under surface of the cover member is formed. In the shaft 167, a bolt hole (not illustrated) is formed along the longitudinal direction of the shaft 167. In addition, an outer diameter of the shaft 167 is less than an inner diameter of the through-hole 164 formed in the rotary member 151 and the shaft 167 can be inserted into the through-hole 164 of the rotary member 151.

Thus, as illustrated in FIGS. 4A and 4B and FIG. 5, in a state in which the attachment hole 121 of the attachment portion 113 of the pushing plate 110, the through-holes 164 of the pair of rotary members 151, and the shaft 167 of the cover member 153 are matched in the perpendicular direction Z, the connection member 154 is screwed into the bolt hole of the shaft 167 and thereby, the switching section 150 is configured. In addition, in this case, the coil spring 152 is disposed in a state of being compressed between the spring receiving portions 162 of the pair of rotary member 151. That is, the coil spring 152 biases the base end sides (sides of the grip portions 161) of the pair of rotary members 151 to be separated from each other and biases the tip sides (sides of the engagement portions 163) of the pair of rotary members 151 to be close to each other.

In addition, as illustrated in FIGS. 4A and 4B, in the switching section 150, the grip portions 161 of the pair of rotary members 151 face sides opposite to each other having a predetermined gap therebetween in the width direction X and thereby, a user can grip the grip portions 161 with fingers.

In this manner, when the user grips the grip portions 161 of the pair of rotary members 151, the pair of rotary members 151 rotate in a direction to compress the coil spring 152 and the engagement portions 163 provided on the tip portions of the rotary members 151 are close to each other. In addition, when the user does not grip the grip portions 161 of the pair of rotary members 151, the pair of rotary members 151 rotate in a direction to elongate the coil spring 152 due to an elastic force of the coil spring 152 and the engagement portions 163 provided on the tip portions of the rotary members 151 are separated from each other.

Here, positions of the grip portions 161 formed when the grip portions 161 are gripped by a user are referred to as "gripped positions" and positions of the grip portions 161 formed when the grip portions 161 are not gripped by a user are referred to as "grip-released positions".

Next, a mounting state of the medium pressing unit 100 over the medium support 41 will be described with reference to FIG. 3.

As illustrated in FIG. 3, when the medium pressing unit 100 is mounted, the engagement portions 163 of the medium pressing unit 100 engage with the protruding section 46 of the medium support 41 and the latching portion 112 of the medium pressing unit 100 is latched to the convex latching portion 45 of the latching groove 44 of the medium support 41.

Thus, the base plate section 111 and the second regulation section 116 of the medium pressing unit 100 come into surface contact with the support surface 42 of the medium support 41 and the first regulation section 115 of the medium pressing unit 100 does not come into surface contact with the support surface 42 of the medium support 41. Then, a gap between the base plate section 111 and the second regulation section 116 and the support surface 42 is narrower than a thickness of the medium M such that the gap has a degree of narrowness to enable the medium M to pass therethrough. Meanwhile, between the first regulation section 115 and the support surface 42, a gap is formed having a degree of narrowness to allow the medium M to pass therethrough.

In addition, as illustrated in FIG. 3, when the medium pressing unit 100 is mounted, a portion of the base plate section 111 and the first regulation section 115 of the medium pressing unit 100 on the upstream side in the transport direction faces the print head 53 in a plan view in the width direction X. In addition, in the plan view, the switching section 150 (grip portions 161) of the medium pressing unit 100 are disposed on the downstream side from the print head 53 in the transport direction.

Further, as illustrated in FIG. 3, when the medium pressing unit 100 is mounted, since the coil spring 152 of the medium pressing unit 100 is restored in a direction to extend, the engagement portions 163 of the pair of rotary members 151 are biased to be separated from each other and the engagement portions 163 pushes the protruding section 46 of the medium support 41 to the upstream side in the transport direction. Then, the latching portion 112 of the medium pressing unit 100, which is latched to the convex latching portion 45 of the latching groove 44 of the medium support 41 is likely to shift to the downstream side in the transport direction and perpendicularly downward such that the latching portion 112 is squeezed into a space perpendicularly below the convex latching portion 45. As a result, the pushing plate 110 is likely to shift in the same direction (on the downstream side in the transport direction and perpendicularly downward) and thereby, the pushing plate 110 more strongly pushes the support surface 42 of the medium support 41. In this manner, according to the present embodiment, the elastic force of the coil spring 152 of the medium pressing unit 100 becomes a force of pressing the pushing plate 110 against the support surface 42 of the medium support 41 in an engagement relationship between the medium pressing unit 100 and the medium support 41.

As illustrated in FIG. 3, when the medium pressing unit 100 is mounted, the grip portions 161 of the medium pressing unit 100 are disposed at the grip-released position. In this respect, in the medium pressing unit 100 of the present embodiment, in a case where the medium pressing unit 100 is disposed at the grip-released position, the medium pressing unit 100 is in a "pushing state" in which the medium pressing unit 100 can push the medium M to the medium support 41.

In addition, as illustrated in FIG. 3, in the medium pressing unit 100, since a flat surface formed by the curvature forming portion 114 is positioned perpendicularly below from a flat surface formed by the switch 111 and the second regulation section 116, the pushing plate 110 of the medium pressing unit 100 is curved over the medium support 41 when the medium pressing unit 100 is mounted. To be more specific, the base plate section 111 and the first regulation section 115 of the pushing plate 110 is curved such that a distance from the support surface 42 of the medium support 41 thereto becomes wider in advancing in the transport direction W. Then, a portion of the base plate section 111 and the first regulation section 115 on the upstream side in the transport direction and the second regulation section 116 are more strongly pressed against the support surface 42 of the medium support 41, compared to a position of the base plate section 111 and the first regulation section 115 on the downstream side in the transport direction.

Next, operations of the printing apparatus 11 of the present embodiment will be described with reference to FIG. 7A to FIG. 10.

Figure 7A:
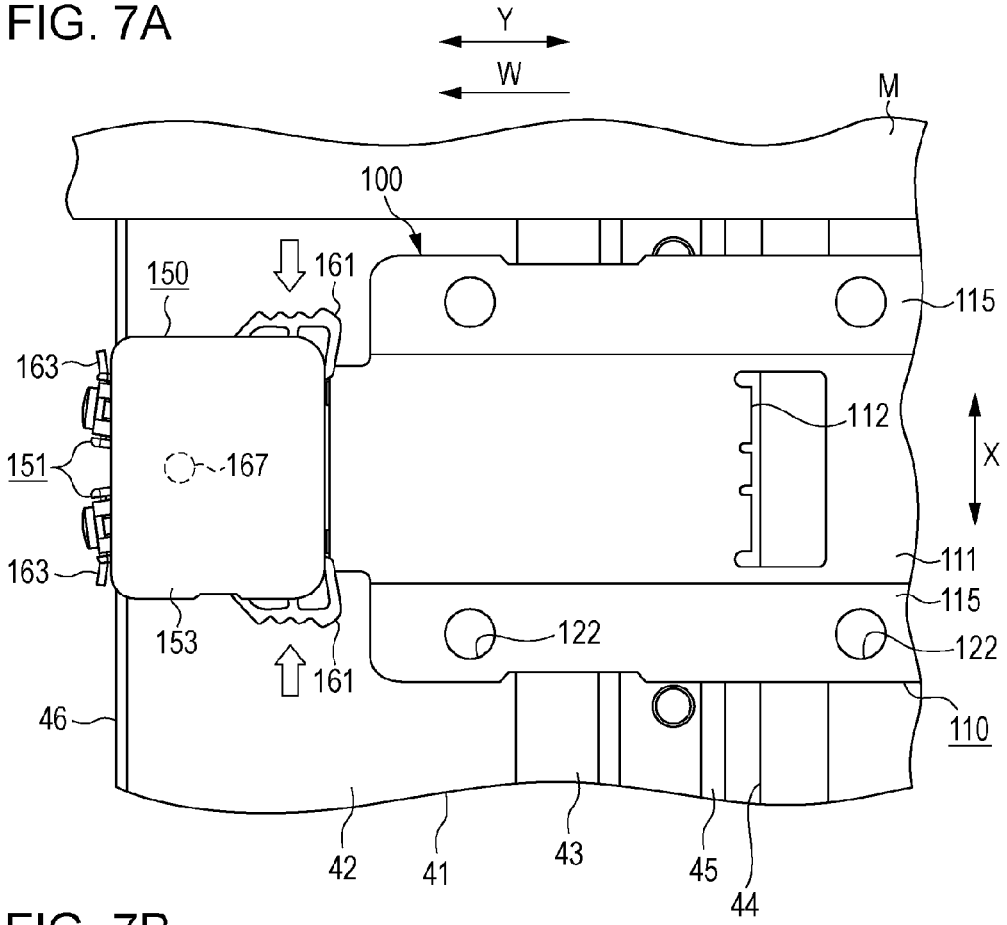
FIGS. 7A and 7B are views illustrating a state in which a grip section of the medium pressing unit mounted on the medium support is gripped.
Figure 7B:
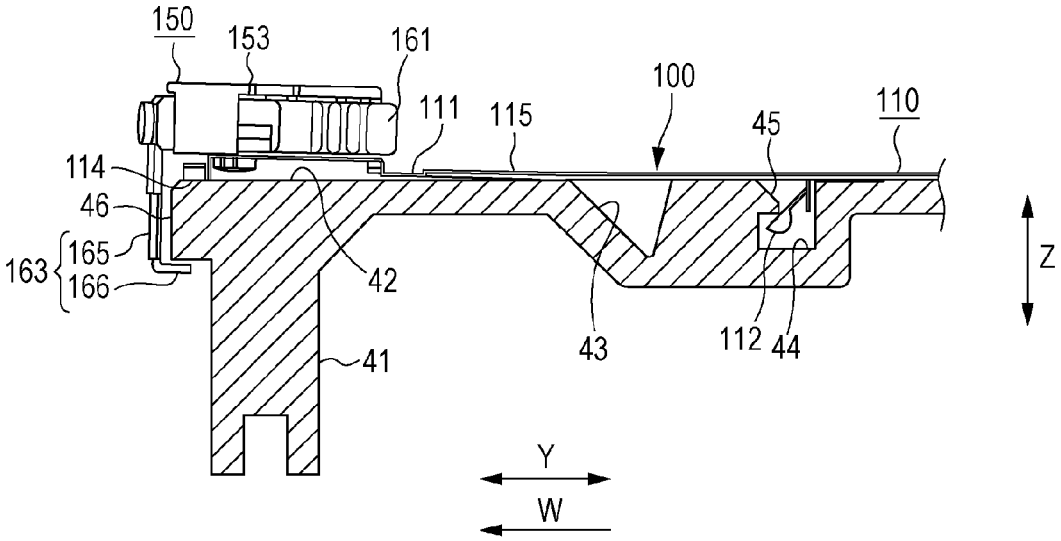

As illustrated in FIGS. 7A and 7B, in the printing apparatus 11 of the present embodiment, in a case of printing on the medium M, the medium pressing unit 100 is caused to move such that both end portions of the medium M in the width direction X overlaps with the first regulation section 115 of the medium pressing unit 100 after the medium M is transported over the medium support 41.

That is, as illustrated in FIGS. 7A and 7B, a user grips the grip portions 161 of the medium pressing unit 100 in a white arrow direction and positions the grip portion 161 at the gripped position and thereby rotates the rotary members 151 about the shaft 167 with an axial line direction as a rotating axis direction. In this manner, the first engagement portions 165 of the rotary members 151 are separated from the protruding section 46 of the medium support 41 and thereby, the engagement relationship is released.

Figure 8A:
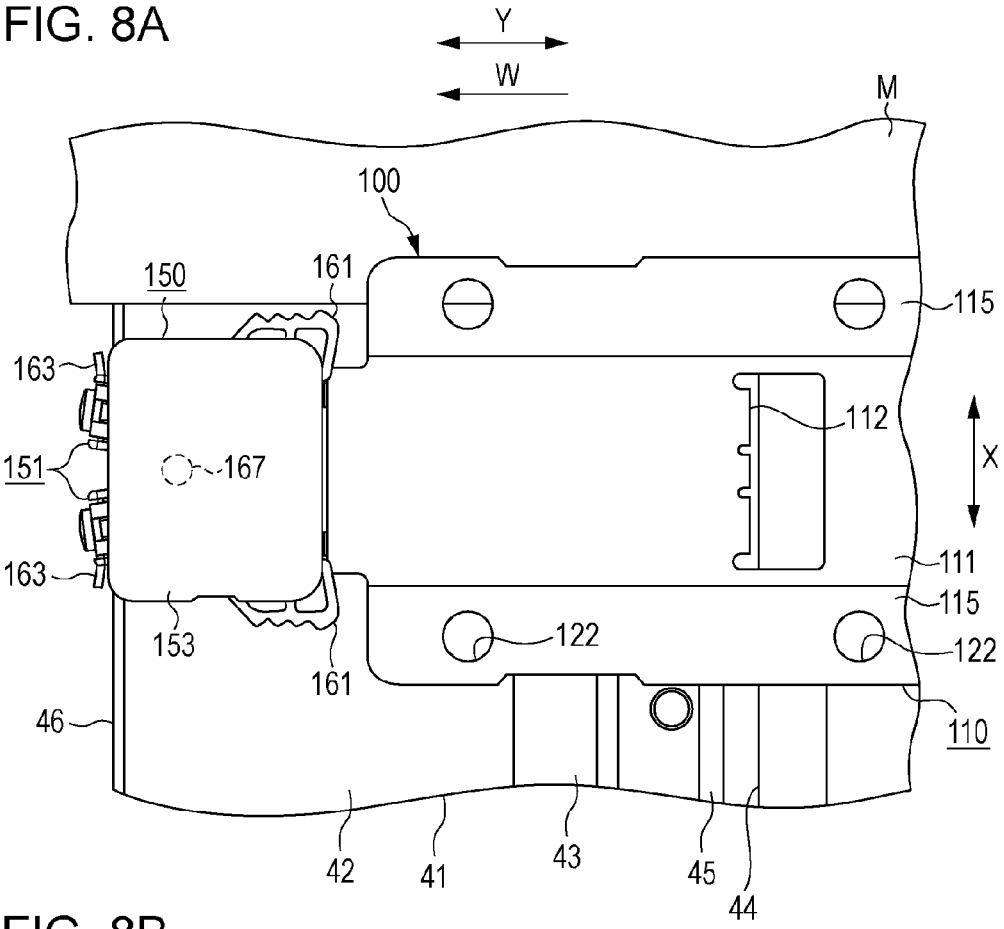
FIGS. 8A and 8B are views illustrating a state in which the medium pressing unit mounted over the medium support is caused to move in a width direction.
Figure 8B:
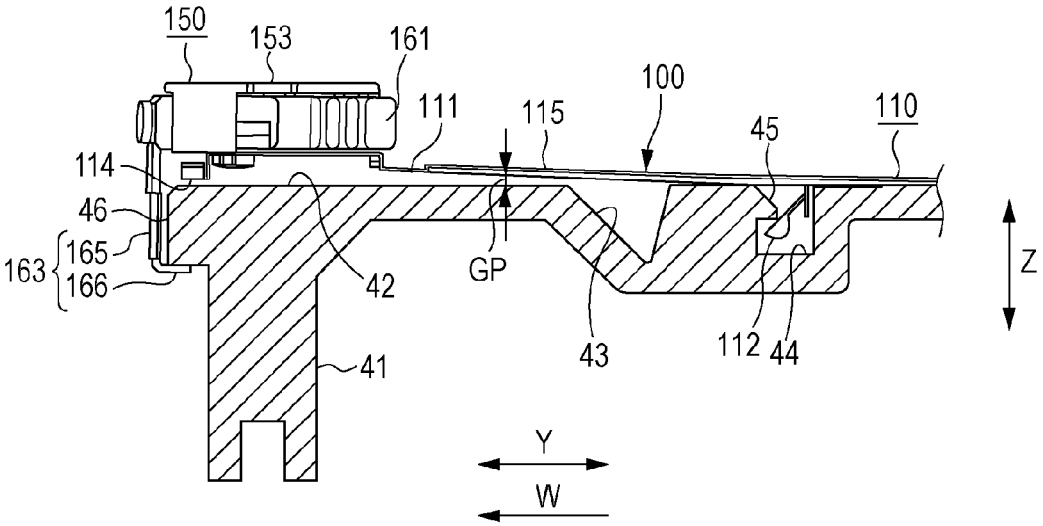

Thus, as illustrated in FIG. 8B, the user slightly moves the medium pressing unit 100 to the upstream side in the transport direction in a state of gripping the grip portions 161, perpendicularly lifts the medium pressing unit 100 upward, and thereby, a gap GP is formed between the base plate section 111 and the curvature forming portion 114 of the medium pressing unit 100 and the support surface 42 of the medium support 41. In this manner, the medium pressing unit 100 is in a "non-pushing state" in which the medium M can be fused to the medium support 41.

In this respect, in a case where the grip portions 161 are positioned at the gripped positions, the medium pressing unit 100 is allowed to enter into the "non-pushing state" in which the medium M can be pushed to the medium support 41 in the width direction X. In addition, when the medium pressing unit 100 is in the non-pushing state, the gap GP is allowed to be formed between the medium support 41 and the medium pressing unit 100 by perpendicularly lifting the medium pressing unit 100 upward.

Subsequently, as illustrated in FIG. 8A, the user moves the medium pressing unit 100 in the width direction X to a position at which the end portion of the medium M is viewed through the viewing window 122 of the first regulation section 115. Here, since the medium pressing unit 100 moves in the width direction X in the non-pushing state, a sliding resistance thereof against the medium support 41 is reduced and the medium pressing unit 100 is likely to move to a target position. A movement direction of the medium pressing unit 100 also means a direction in which the grip portions 161 of the medium pressing unit 100 are shifted from the grip-released position to the gripped positions.

Thus, the user does not grip the grip portions 161 of the medium pressing unit 100, the grip portions 161 are changed from the gripped position to the grip-released position, and the medium pressing unit 100 is switched from the non-pushing state to the pushing state. In this manner, the medium M which is transported over the medium support 41 is suppressed not to bend from the surface of the medium support 41 in a state in which both end portions of the medium M in the width direction X are transported between the first regulation section 115 of the medium pressing unit 100 and the support surface 42 of the medium support 41.

As a result, when the carriage 52 reciprocates along the guide shaft 51 in the width direction X, the print head 53 held in the carriage 52 and the medium M are suppressed not to come into contact with each other. In addition, the print head 53 is suppressed not to discharge ink on the medium M bending from the support surface 42 of the medium support 41 and thus, print quality with respect to the medium M is suppressed not to deteriorate.

In addition, as illustrated in FIG. 8B, in a case where the medium pressing unit 100 is perpendicularly lifted upward, the second engagement portion 166 of the medium pressing unit 100 engages with the protruding section 46 of the medium support 41 and thereby, a range of the gap GP formed between the medium pressing unit 100 and the medium support 41 is confined. That is, even in a case where the medium pressing unit 100 is in the non-pushing state, the medium pressing unit 100 is not separated from the medium support 41. Accordingly, according to the medium support 41 of the present embodiment, when the medium pressing unit 100 is moved in the width direction X, the medium pressing unit 100 is suppressed not to be separated from the medium support 41 and a concern of losing the medium pressing unit 100 is reduced. In addition, in this respect, the second engagement portion 166 corresponds to an example of a "confinement portion".

As described above, according to the present embodiment, even in a case where the medium pressing unit 100 is in the pushing state or in the non-pushing state, it is not possible to remove the medium pressing unit 100 from the medium support 41 only through lifting the medium pressing unit 100 from the medium support 41. Accordingly, detachment and attachment of the medium pressing unit 100 from and to the medium support 41 is performed from one end portion of the medium support 41 in the width direction X.

Figure 9A:
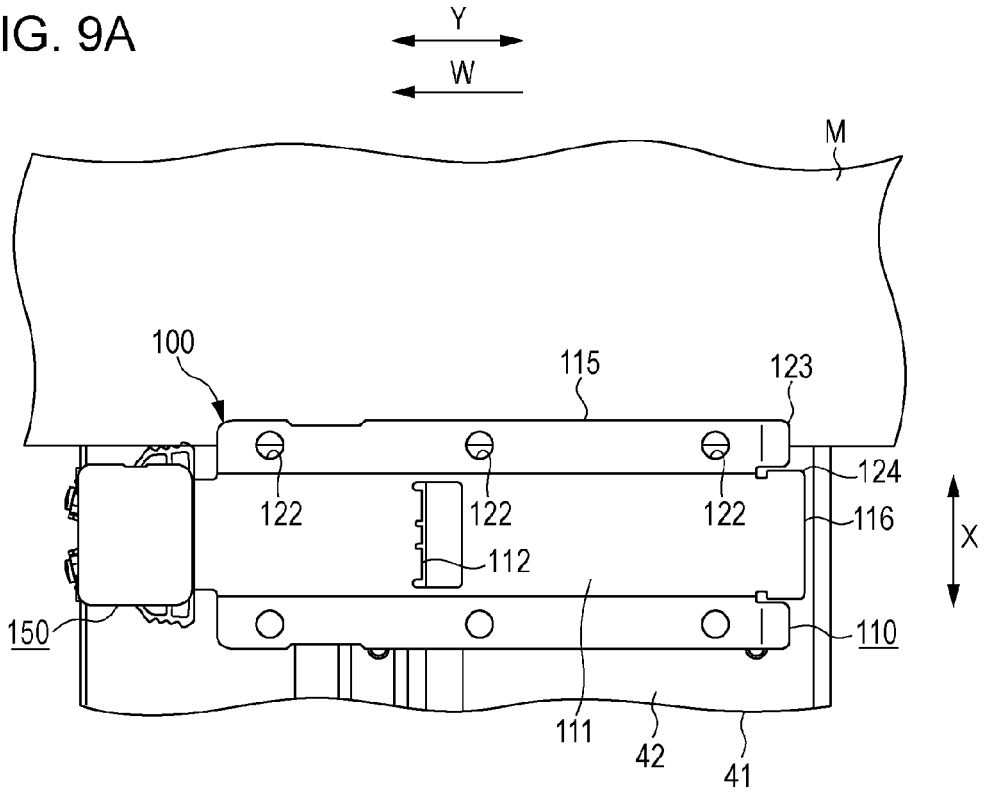
FIGS. 9A and 9B are plan views illustrating a mode of the medium which is transported over the medium support.

In addition, as illustrated in FIG. 9A, in a case where the medium M is caused to be transported over the medium support 41, it is preferable that the medium M is transported in the transport direction W in a state in which the longitudinal direction of the medium support 41 is substantially orthogonal to the transport direction W of the medium M. However, when ununiform transport resistance is generated in the width direction X on the transport path of the medium M or a winding direction of the medium M of the rolled body R1 is ununiform in the width direction X, the medium M gradually skews off a designed transport direction W along with the transport of the medium M in some cases.

Figure 9B:
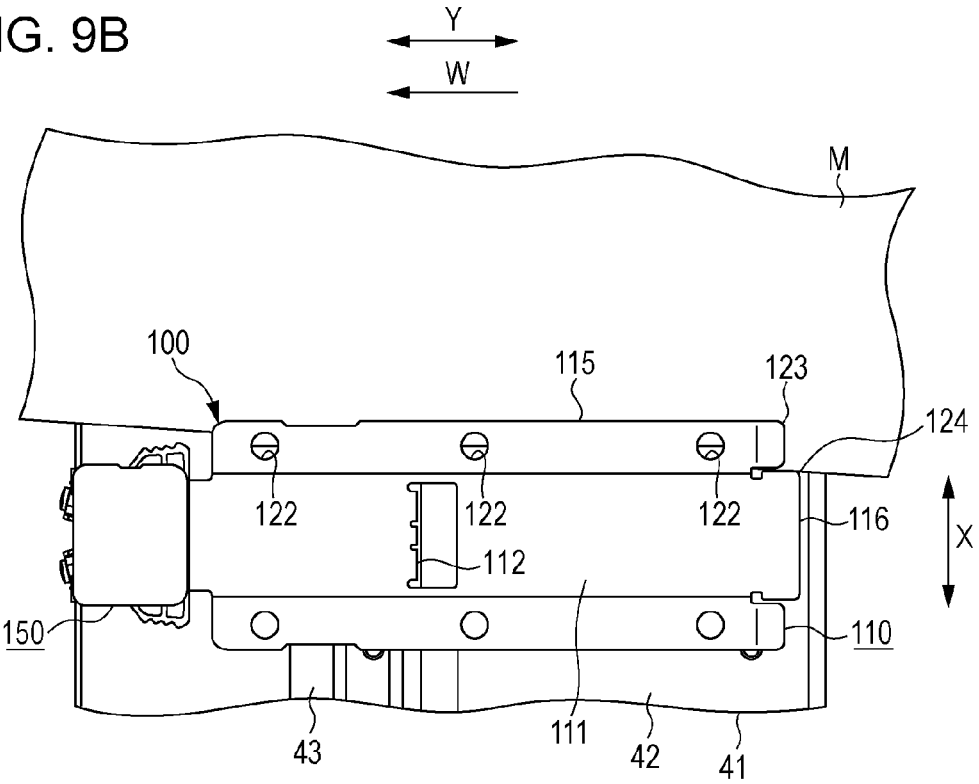

Here, according to the present embodiment, as illustrated in FIG. 9B, when the medium M starts skewing along with the transport of the medium M, a side-end surface of the medium M, which intersects with the width direction X, comes into contact with the contact surface 124 of the second regulation section 116 of the medium pressing unit 100 on one side (lower side in FIG. 9B) of the medium M in the width direction X. That is, the medium M comes into contact with the contact surface 124 of the second regulation section 116 such that the skewing is regulated within a range thereof. At this time, according to the present embodiment, since the second regulation section 116 of the pushing plate 110 is strongly pressed against the support surface 42 of the medium support 41, the medium M is unlikely to advance between the second regulation section 116 and the support surface 42 such that the medium M is unlikely to skew more than that.

Further, in the medium pressing unit 100 according to the present embodiment, since the contact surface 124 of the second regulation section 116 is provided on the most upstream side in the transport direction W, the skewing of the medium M is regulated when a skewing amount of the medium M is relatively small compared to a case where the contact surface 124 is provided on the downstream side from the second regulation section 116. In addition, in the medium pressing unit 100, since the contact surface 124 of the second regulation section 116 is provided to overlap with the first regulation section 115 in the width direction X, the skewing of the medium M is regulated when a skewing amount of the medium M is relatively small compared to a case where the contact surface 124 of the second regulation section 116 is provided not to overlap with the first regulation section 115. Here, the skewing amount of the medium M means an angle between the designed transport direction W (frontward-rearward direction Y) of the medium M and an actual transport direction. That is, in a case where the medium M is transported in the designed transport direction W, the skewing amount of the medium M is "0 (zero)".

In addition, in the printing apparatus 11, printing is performed on a medium M which is different in length in the width direction X, in some cases. In this case, the medium pressing unit 100 is caused to be retracted to the outer side from the medium M before the rolled body R1 held in the winding shaft 20 is replaced and the medium M unwound from the rolled body R1, which is different in length in the width direction X, is transported to the medium support 41. Thus, after the new medium M is transported to the medium support 41, the retracted medium pressing unit 100 is caused to move to match the end portion of the medium M in the width direction X.

Here, when the printing is performed on the medium M long in the width direction X, there is a concern that the medium pressing unit 100 will be hidden under the medium M transported over the medium support 41 and printing will be performed without notifying the user of the state in a case where the medium pressing unit 100 is not retracted to the outer side in the width direction X. In this case, in the printing apparatus 11, there is a concern that the print head 53 will come into contact with the medium M bending from the support surface 42 or the print head 53 will perform printing on the medium M bending from the support surface 42.

Figure 10:
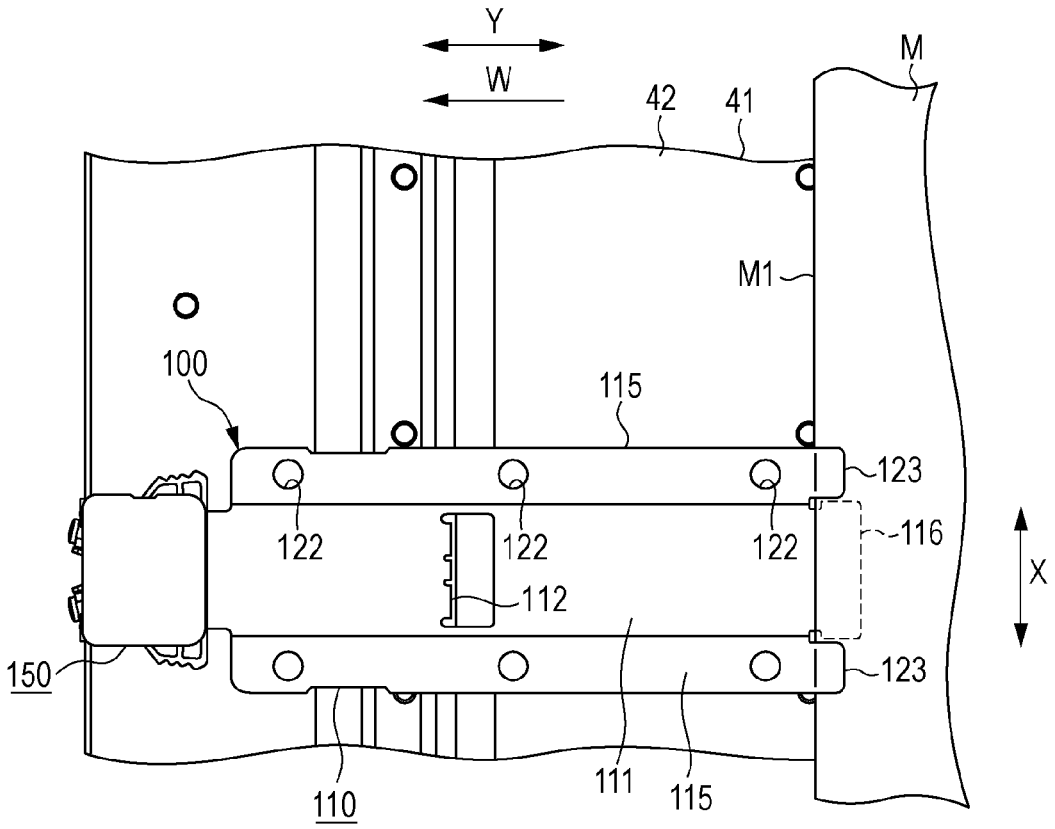
FIG. 10 is a plan view illustrating a mode in which the medium pressing unit regulates the transport of the medium.

In this respect, according to the present embodiment, as illustrated in FIG. 6B, the inclined portion 123 is provided on the downstream side of the medium pressing unit 100 in the transport direction such that a distance between the support surface 42 of the medium support 41 and the inclined portion 123 becomes gradually wider toward the downstream side. Accordingly, as illustrated in FIG. 10, when printing is performed on the medium M long in the width direction X and the user forgets to retract the medium pressing unit 100, an end portion M1 of the transported medium M on the downstream side in the transport direction is transported between the second regulation section 116 and the inclined portion 123 in the perpendicular direction Z and the end portion M1 collides with the connection portion between the second regulation section 116 and the inclined portion 123.

Accordingly, the transport of the medium M over the medium support 41 in the transport direction W is regulated and it is possible to notify the user that the medium pressing unit 100 is not retracted in the width direction X. Therefore, in the printing apparatus 11, the print head 53 is suppressed not to come into contact with the medium M bending from the support surface 42 or not to perform printing on the medium M bending from the support surface 42.

According to the embodiments described above, it is possible to achieve the following effects.

(1) In a case where the medium pressing unit 100 is moved over the medium support 41 in the width direction X in the printing apparatus 11, such as in a case where printing is performed on the medium M different in length in the width direction X, the medium pressing unit 100 is switched from the pushing state to the non-pushing state. Here, in the non-pushing state, since the gap GP is formed between the medium support 41 and the medium pressing unit 100, sliding resistance of the medium pressing unit 100 against the medium support 41 is reduced when the medium pressing unit 100 moves in the width direction X. Therefore, it is possible to cause the medium pressing unit 100 to easily move to a position in accordance with the length of the medium M in the width direction X.

(2) When the medium pressing unit 100 is perpendicularly lifted upward in a case where the medium pressing unit 100 is in the non-pushing state, the second engagement portion 166 of the medium pressing unit 100 engages with the protruding section 46 of the medium support 41. Therefore, the medium pressing unit 100 is suppressed not to be detached from the medium support 41. Accordingly, when the medium pressing unit 100 is caused to move in the width direction X, the medium pressing unit 100 is suppressed not to be detached from the medium support 41 and the concern of losing the medium pressing unit 100 can be reduced.

(3) The grip portion 161 is disposed at the gripped position and thereby, the medium pressing unit 100 can enter into the non-pushing state and the grip portion 161 is disposed at the grip-released position and thereby, the medium pressing unit 100 can enter into the pushing state. Accordingly, a simple operation of gripping the grip portion 161 makes it possible to switch the pushing state of the medium pressing unit 100.

(4) When the medium pressing unit 100 is mounted, the grip portion 161 of the medium pressing unit 100 is disposed on the downstream side from the print head 53 in the transport direction. Therefore, the print head 53 can be unlikely to be touched when the user of the printing apparatus 11 grips the grip portions 161.

(5) A direction in which the grip portions 161 shift when the grip portions 161 are gripped becomes a direction (width direction X) parallel to the direction in which the medium pressing unit 100 is caused to move and thereby, it is possible to cause the medium pressing unit 100 to more intuitively move compared to a case where the direction in which the grip portions 161 shift becomes another direction (for example, the perpendicular direction Z).

(6) When the medium pressing unit 100 is mounted, the second regulation section 116 which regulates the movement of the medium M toward the outer side in the width direction is provided on the outer side (side opposite to a transport region of the medium M) from the first regulation section 115 in the width direction X. Accordingly, in a case where the medium M skews over the medium support 41 along with the transport of the medium M, the medium M which is likely to move to the outer side from the first regulation section 115 in the width direction is regulated not to skew beyond the range of skewing by coming into contact with the second regulation section 116 (contact surface 124). Therefore, it is possible to suppress the medium M not to skew over the medium support 41 along with the transport of the medium M.

(7) When the medium pressing unit 100 is mounted, the second regulation section 116 is disposed on the downstream side from the first regulation section 115 in the transport direction. Accordingly, the medium M is likely to come into contact with the second regulation section 116 (contact surface 124) at a state at which the skewing amount of the medium M transported over the medium support 41 is small compared to a case where the second regulation section 116 is disposed on the downstream side from the first regulation section 115 in the transport direction. Therefore, it is possible to further suppress the skewing of the medium M along with the transport of the medium M.

(8) When the medium pressing unit 100 is mounted, the second regulation section 116 has at least a part which overlaps with the first regulation section 115 in the width direction X and thereby, the side-end surface of the medium M, which intersects with the width direction X, is likely to come into contact with the second regulation section 116 at a state at which the skewing amount of the medium M is small compared to a case where the second regulation section 116 is disposed not to overlap with the first regulation section 115. Therefore, it is possible to further suppress the skewing of the medium M along with the transport of the medium M.

(9) When the medium pressing unit 100 is mounted, the inclined portion 123 is provided on the medium pressing unit 100 to be inclined such that the gap from the support surface 42 of the medium support 41 thereto becomes gradually wider toward the upstream side in the transport direction. Accordingly, the end portion M1 of the medium M on the downstream side in the transport direction collides with the connection portion between the second regulation section 116 and the inclined portion 123 without retracting the medium pressing unit 100 depending on the length of the medium M in the width direction X, which is newly transported over the medium support 41 when the medium M is transported over the medium support 41. In this manner, the medium M to be transported is not transported beyond the range and thereby, it is possible to notify the user of the printing apparatus 11 that the medium pressing unit 100 is disposed at an inappropriate position. Therefore, the printing can be unlikely to be performed in a state in which it is not possible for the medium pressing unit 100 to regulate the bending of the medium M.

(10) since, in the pushing plate 110 of the medium pressing unit 100, the first regulation section 115 and the second regulation section 116 are formed through integral molding, it is possible to simply configure the medium pressing unit 100.

(11) The curvature forming portion 114 provided on the downstream side of the medium pressing unit 100 in the transport direction more strongly presses the portion of the pushing plate 110 on the upstream side in the transport direction than the portion on the downstream side in the transport direction against the support surface 42 of the medium support 41. Therefore, it is possible to suppress the print quality with respect to the medium M not to deteriorate in that the printing unit 50 performs printing on the medium M pressed against the support surface 42 in the portion of the pushing plate 110 on the upstream side in the transport direction.

(12) Unlike the engagement portion 163 of the medium pressing unit 100, the latching portion 112 of the medium pressing unit 100 is latched to the convex latching portion 45 of the latching groove 44 formed in the support surface 42 of the medium support 41. In this respect, on the upstream side of the medium support 41 in the transport direction, there is no need to provide a shape like the protruding section 46 provided on the downstream side of the medium support 41 in the transport direction and it is possible to dispose the transport roller 31 in a state of being close to the medium support 41.

The embodiments described above may be modified as follows.

- the second engagement portion 166 as an example of the confinement portion may not be provided in the switching section 150 of the medium pressing unit 100. Even in this case, it is possible to achieve the effect (1) of the embodiment described above.
- In the transport direction W, the switching section 150 (grip portion 161) of the medium pressing unit 100 may be provided in the medium pressing unit 100 to be disposed on the upstream side from the print head 53 in the transport direction and may be provided in the medium pressing unit 100 to overlap with the print head 53 in the transport direction W.
- The direction in which the grip portion 161 is shifted from the grip-released position to the gripped position may be within a certain range of an angle (for example, within 30 degrees) with respect to the width direction X. Alternatively, the direction in which the grip portion 161 is shifted from the grip-released position to the gripped position may not be a direction parallel to the width direction X, but, for example, may be a direction parallel to the perpendicular direction Z or may be a direction parallel to the transport direction W.
- The grip portions 161 may cause the medium pressing unit 100 to enter into the non-pushing state when pressed down and the grip portions 161 may be an operating portion which allows the medium pressing unit 100 to enter into the pushing state when not pressed down.
- The switching section 150 which switches between the pushing state of the pushing plate 110 may not be provided in the medium pressing unit 100. Even in this case, it is possible to achieve the effects (6) to (10) of the embodiments described above.
- The second regulation section 116 of the medium pressing unit 100 may be provided, in the transport direction W, at a position to overlap with the first regulation section 115 or may be provided on the downstream side from the first regulation section 115.

The second regulation section 116 of the medium pressing unit 100 may be provided at a position not to overlap with the first regulation section 115 in the width direction X.

The inclined portion 123 may not be provided in the medium pressing unit 100. In this case, in order for the user not to forget to retract the medium pressing unit 100 in the width direction X, it is preferable that whether or not the medium pressing unit 100 is properly mounted is inquired of the user before a new medium M is transported over the medium support 41.

The curvature forming portion 114 may not be provided in the medium pressing unit 100.

the pushing plate 110 of the medium pressing unit 100 may not be formed by bending a metal plate but may be formed integrally through injection molding of a resin. In addition, the pushing plate 110 of the medium pressing unit 100 may be configured in combination of a plurality of separated members.

The mode of engaging the medium pressing unit 100 with the medium support 41 may be differently performed from the embodiments described above. For example, a magnetic force may be used to engage the medium pressing unit 100 with the medium support 41. In this case, the medium pressing unit 100 enters into the pushing state when the strong magnetic force is applied and the medium pressing unit 100 may enter into the non-pushing state when the weak magnetic force is applied.

The medium support 41 may be curved to form an arc in the width direction X in a side view. In this case, it is preferable that the pushing plate 110 of the medium pressing unit 100 is curved along a support surface of such a medium support. In addition, in this case, the transport direction corresponds to a direction parallel to the curved support surface.

The medium M may be cut paper, a resin or metal film, a fabric, a non-woven fabric, a ceramic sheet, or the like. In addition, the medium M may be a transferring medium for transferring a printed character or image to another medium.

The printing apparatus 11 may be a line printer or a page printer.

The printing apparatus 11 may not be the ink jet type printer. For example, the printing apparatus 11 may be a dot impact type printer, a laser printer, or another type of printer.

The entire disclosure of Japanese Patent Application No. 2014-200705, filed Sep. 30, 2014 is expressly incorporated by reference herein.

What is claimed is:

1. A printing apparatus comprising:

a transport unit that transports a medium in a transport direction;

a medium support that supports the medium;

a plate shaped medium pressing unit that has a first regulation section that regulates bending of an end portion of the medium from the medium support in a width direction intersecting with the transport direction and a second regulation section that regulates a movement of the end portion of the medium to an outer side in the width direction; and a printing unit that performs printing on the medium supported on the medium support.

2. The printing apparatus according to claim 1, wherein the second regulation section is provided on the upstream side from the first regulation section in the transport direction.

3. The printing apparatus according to claim 1, wherein the second regulation section has at least a part which overlaps with the first regulation section in the width direction.

4. The printing apparatus according to claim 1, wherein the first regulation section has an inclined portion which is inclined to have a gap that is gradually wider from the medium support toward the upstream side in the transport direction, and wherein the second regulation section and the inclined portion are connected at a point that is on the downstream side in the transport direction from an end of the second regulation section that is the most upstream portion in the transport direction of the medium pressing unit.

5. The printing apparatus according to claim 1, wherein the first regulation section and the second regulation section in the medium pressing unit are formed through integral molding.

* * * * *